US006806628B2

(12) United States Patent
Suzuki

(10) Patent No.: US 6,806,628 B2
(45) Date of Patent: Oct. 19, 2004

(54) SPARK PLUG

(75) Inventor: Akira Suzuki, Aichi (JP)

(73) Assignee: NGK Spark Plug Co., Ltd., Aichi (JP)

( * ) Notice: Subject to any disclaimer, the term of this patent is extended or adjusted under 35 U.S.C. 154(b) by 0 days.

(21) Appl. No.: 10/304,707

(22) Filed: Nov. 27, 2002

(65) Prior Publication Data

US 2003/0102791 A1 Jun. 5, 2003

(30) Foreign Application Priority Data

Nov. 30, 2001 (JP) ..... 2001-366640

(51) Int. Cl.[7] ..... H01J 13/20
(52) U.S. Cl. ..... 313/143; 313/126
(58) Field of Search ..... 313/128, 130, 313/137, 143

(56) References Cited

U.S. PATENT DOCUMENTS 4,015,161 A * 3/1977 Resler, Jr. ..... 313/143
5,760,533 A 6/1998 Saiki et al.

FOREIGN PATENT DOCUMENTS

EP 1 107 406 A1 6/2001
JP 08-273801 10/1996
JP 2001-155839 6/2001

* cited by examiner

*Primary Examiner*—Vip Patel
(74) *Attorney, Agent, or Firm*—Sughrue Mion, PLLC

(57) ABSTRACT

In a spark plug 100, the outer diameter of a tool engaging portion 1*e* formed on a main metal member 1 is not larger than 14 mm. An insulator 2 is provided with a expanded diameter portion (2*e*) positioned within the main metal member 1 and projecting radially outward from an outer circumferential surface of the insulator, and an intermediate trunk portion (2*g*) adjacent to an axial front side of the expanded diameter portion (2*e*) and having a cylindrical outer circumferential surface. The inclined portion (2*j*) has a linearly inclined outer circumferential surface formed in a position so as to connect the expanded diameter portion (2*e*) and intermediate trunk portion (2*g*), and formed so that in orthogonal projections with respect to a plane of projection parallel to an axis O, the diameters become smaller from the side of the expanded diameter portion (2*e*) toward that of the intermediate trunk portion (2*g*). In the position in which an extension of the outer circumferential surface of the inclined portion (2*j*) and that of the outer circumferential surface of the intermediate trunk portion (2*g*) cross each other, a built-up portion (2*k*) is formed so that a valley-like space defined by these two extensions is filled.

8 Claims, 8 Drawing Sheets

SPARK PLUG

BACKGROUND OF THE INVENTION

1. Field of the Invention

This invention relates to a spark plug for internal combustion engines, and a method of manufacturing the same.

2. Description of the Related Art

A spark plug used for the ignition of an internal combustion engine, for example, a gasoline engine for automobiles, etc., has a structure including an insulator on an outer side of a central electrode, a main metal member on an outer side of the insulator, and an earth electrode forming a spark discharge gap between the earth electrode and central electrode and fixed to the main metal member. Such a spark plug is fixed to a cylinder head of an engine via an attaching screw portion formed on an outer circumferential surface of the main metal member, and then put to use. Since the portion of the electrode which forms a spark discharge gap is exposed to a combustion gaseous mixture during an operation of the engine, the temperature of this portion becomes extremely high.

With an increase in recent years in output from an internal combustion engine used for automobiles, etc., the areas occupied by suction and exhaust valves in a combustion chamber have also increased. This makes it necessary to miniaturize the spark plug used to ignite a gaseous mixture, and the temperature of the interior of a combustion chamber tends to become increasingly higher due to a supercharging unit, such as a turbocharger. In order to secure the lifetime of a spark plug satisfactorily even in such a severe condition of use, it is necessary to design the spark plug so as to provide good heat radiation (reduction of heat). The heat of the spark plug is discharged through various paths. Especially, a path extending from an insulator to a cylinder head via an attaching screw portion of a main metal member has a high heat flow, and plays an important role in securing reliable heat radiation. Under these circumstances, an attempt to improve the heat radiation performance of a spark has been made by further increasing the length (screw reach) of this attaching screw portion. When a screw reach is increased, the length of the insulator provided within the main metal member naturally also increases.

Concerning a main metal member of a spark plug, the demand has increased for the reduction of the sizes of portions other than an attaching screw portion, in particular reduction of the hexagonal portion (tool engaging portion) which projects outward from a position higher than that of the attaching screw portion and which is provided so that a wrench can be engaged therewith. The situation causing this demand will be described below. The space above the cylinder head has lost superfluidity due to employing a direct ignition system in which each ignition coil is fixed directly to an upper portion of a spark plug, and the diameter of the plug hole has decreased due to an increase in the areas occupied by the above-mentioned valves. As a result, the distance between opposite sides of the hexagonal portion necessarily decreases to 14 mm or smaller, and since only a hexagonal portion not smaller than 16 mm could be secured in a related art spark plug, a decrease in the diameter of an insulator is further required.

3. Problems to Be Solved by the Invention

When an impact is exerted on an insulator, in which the reduction of the diameter in the direction crossing the axis of a spark plug and the enlargement in the axial direction of the length thereof were effected as mentioned above, problems such as bending and the like of the insulator become liable to occur. In a spark plug of a general structure, a flange type projecting portion called an expanded diameter portion is provided on an outer circumferential surface of the insulator, and a main metal member is joined with the expanded diameter portion by clamping with the rear end portion of the main metal member directed toward this expanded diameter portion. A valley-like section is formed in the inner circumferential edge of the end surfaces of this flange-like expanded diameter portion extending in the circumferential direction, and this valley-like section tends to receive stress concentration in particular due to a notch effect. Since this expanded diameter portion is formed in a position comparatively close to a hexagonal portion (tool engaging portion) of a main metal member, the expanded diameter portion is liable in particular to be influenced by the reduction in the diameter of the hexagonal portion. Therefore, when excessive torsion is exerted on an insulator via the main metal member during the driving of an attaching screw portion into an engine head, or, when an impact is imparted to a plug head portion during the fixing of a spark plug to the engine head, especially, problems, such as bending and the like of the insulator of a small diameter and a large length become liable to occur due to both the increase in bending moment and a decrease in the cross-sectional area of the insulator.

SUMMARY OF THE INVENTION

Therefore, an object of the present invention is to provide a spark plug capable of effectively preventing the insulator from being bent during a spark plug fixing operation or when an impact, etc., is imparted to the spark plug due to external causes other than the spark plug fixing force despite the use of an insulator having a diameter which is reduced in accordance with a decrease in the dimensions of a tool engaging portion thereof.

The above object of the present invention has been achieved by providing a spark plug including a shaft type central electrode 3, a shaft type insulator 2 covering an outer side of the central electrode 3, a main metal member 1 which is formed cylindrically so as to be opened at both ends thereof, and which is disposed on an outer side of the insulator 2, and an earth electrode 4 combined at one end thereof with the main metal member 1 and opposed at the other end thereof to the central electrode 3 so as to form a spark discharge gap g, said spark plug having a center axis O in the axial direction of the insulator 2, wherein:

the main metal member is provided on an outer circumferential surface thereof with an attaching screw portion 7 and a tool engaging portion 1*e* for turning the screw portion 7 into a threaded hole in an internal combustion engine, the interval between opposite sides Σ; of the tool engaging portion 1*e* being not greater than 14 mm, the side in the axial direction of the insulator 2 on which the spark discharge gap g is formed is defined as the front side and the opposite side thereof is defined as the rear side, the insulator 2 being provided with a expanded diameter portion 2*e* positioned in the main metal member 1 and projecting radially outward from the outer circumferential surface of the insulator 2, and an intermediate trunk portion 2*g* having a cylindrical outer circumferential surface, formed adjacently in the axial direction to the front side of the expanded diameter portion 2*e* and engaged at its front end with a main metal member-side engaging section 1*c* formed on an inner circumferential surface of the main metal member 4, an outer circumferential surface of an inclined portion 2*j* forms a linear incline in a position connecting the expanded diameter portion 2*e* and intermediate trunk portion 2*g*, such that the diameter of the inclined portion 2*j* decreases from the side of the expanded diameter portion 2*e* toward the intermediate trunk portion 2*g* in orthogonal projections parallel to said axis, a built-up portion 2*k* being formed where the extension of the outer circumferential surface of the inclined portion 2*j* and that of the intermediate trunk portion 2*g* cross each other, such that a valley-like space defined by these extensions is filled with the built-up portion 2*k*.

Referring to the appended claims and the above description, the reference symbol following the name of each structural element is used in reference to that added to a corresponding part illustrated in the attached drawings (FIG. 1, FIG. 2 and FIG. 3). These reference symbols are added so as to only make the present invention easily understood, and do not limit at all the concept of each structural requirement for the invention.

The present invention also relates to a spark plug in which the length between opposite sides of the tool engaging portion 1*e* formed on the main metal member 1 is not larger than 14 mm due to the above-mentioned circumstances which cause the diameter of the insulator 2 to be reduced. In the insulator 2 of this spark plug, a valley-like space extending in the circumferential direction thereof is formed between the outer circumferential surface of the inclined portion 2*j*, adjoining one edge of the expanded diameter portion 2*e*, and the intermediate trunk portion 2*g*. When torsion of a wrench occurring during a spark plug installation operation and other impact force occurring during the same operation are imparted to the valley-like portion to cause bending moment to work on the same, stress concentration is liable to occur thereon. However, according to the present invention, the built-up portion 2*k* is provided where the extension of the outer circumferential surface of the inclined portion 2*j* and that of the outer circumferential surface of the intermediate trunk portion 2*g* cross each other, so as to fill the valley-like space therewith. This can prevent the stress concentration from occurring, and enables the bending resistance etc. of the insulator to be improved by a large margin.

DESCRIPTION OF THE REFERENCE SYMBOLS

100 Spark Plug

1 Main Metal Member

1*e* Tool Engaging Portion

1*g* Fixing Seat Portion

2 Insulator

2*g* Intermediate Trunk Portion

2*k* Leveled-Up Built-Up Portion

2*j* Inclined Portion

Figures 1A, 1B:
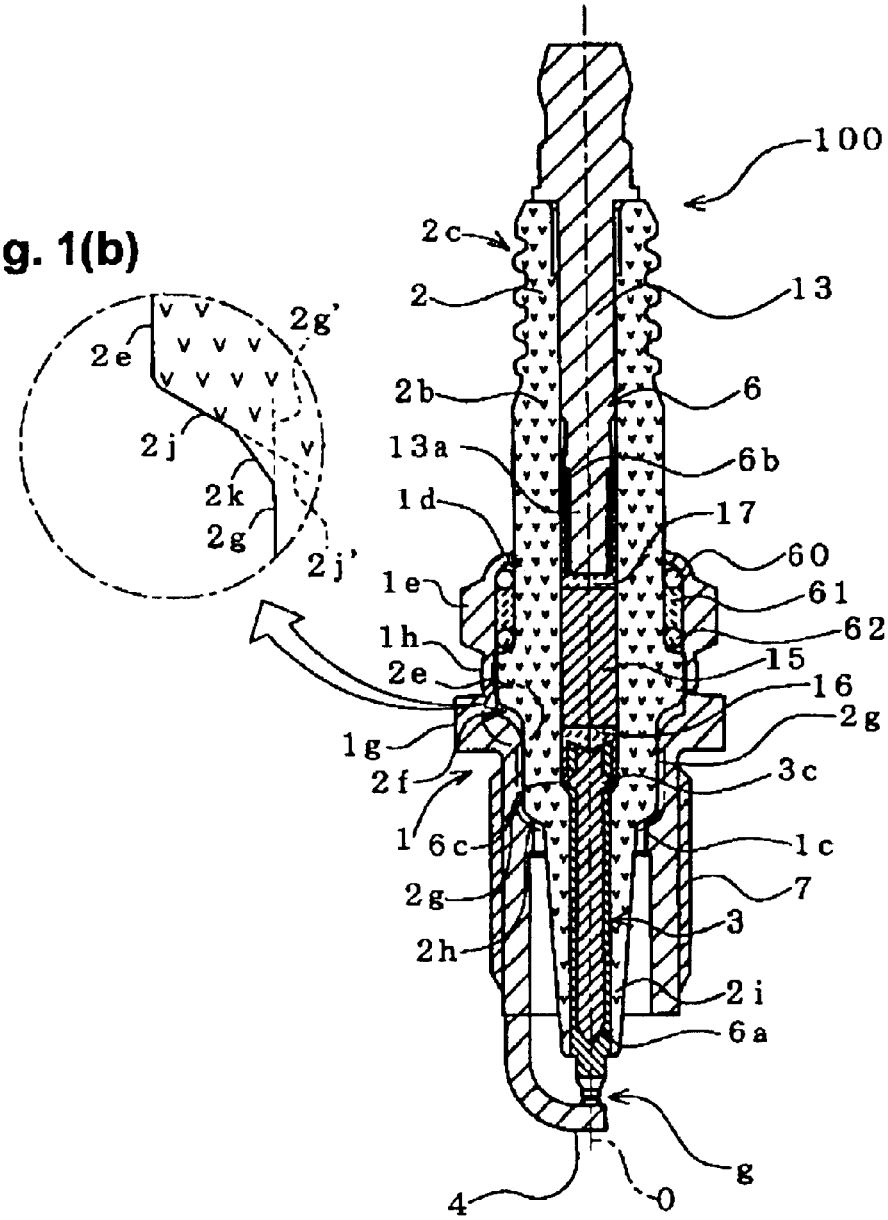
FIG. 1(*a*) is a general longitudinal sectional view showing a spark plug constituting an embodiment of the present invention, and FIG. 1(*b*) is an enlarged sectional view of a principal portion thereof.

4 Earth Electrode g Spark Discharge Gap

2*b* Rear Side Section Of Main Body Portion

R1 Rounded Portion

R2 Rounded Portion

DETAILED DESCRIPTION OF THE INVENTION

An embodiment of the present invention will now be described with reference to an example shown in the drawings. However, the present invention shall not be construed as being limited thereto.

FIG. 1 is a longitudinal sectional view A of a spark plug 100 in a mode of embodiment of the present invention, and an enlarged view B of a principal portion of the example. The spark plug 100 is provided with a cylindrical main metal member 1, an insulator 2 fitted in an inner side of the main metal member 1 so that a front end portion 2*i* projects outward, a central electrode 3 provided in an inner side of the insulator 2, and an earth electrode 4 joined at one end with the main metal member 1 by welding, etc. A spark discharge gap g is formed between the earth electrode 4 and central electrode 3. In the direction of an axis O of the insulator 2, a side on which the spark discharge gap g is formed will hereinafter be called the front side, and a side opposite to this side the rear side.

The insulator 2 is provided in a central position on its axial cross section with a through hole 6 extending in the axial direction thereof, and a terminal metal member 13 is fixed in the rear end portion of the insulator 2 with the central electrode 3 also fixed in a front end portion thereof. In the portion of the interior of the through hole 6 between the terminal metal member 13 and central electrode 3, a resistor 15 is provided. Both end portions of this resistor 15 are electrically connected to the central electrode 3 and terminal metal member 13 respectively via conductive glass seal layers 16, 17. The terminal metal member 13 is provided with a male screw engaging portion 13*a* on an outer circumferential surface of a front end portion thereof, and this engaging portion 13*a* is fitted at a front end section thereof in the conductive glass seal layer 17 so as to thereby increase the bonding strength thereof.

The insulator as a whole is formed of an insulating material, such as alumina. An outwardly projecting cylindrical portion with expanded diameter 2*e* is formed in the shape of a flange on an intermediate section of the insulator 2 in the axial direction. The insulator 2 is formed at its section to the rear of the expanded diameter portion to provide a rear side main body portion 2*b* having a diameter smaller than that of the expanded diameter section. A corrugation 2*c* is provided on the outer circumferential surface of this rear side main body portion 2*b*. An intermediate trunk portion 2*g* of a diameter smaller than that of the expanded diameter portion 2*e*, and a front end portion 2*i* of a diameter still smaller than that of the intermediate trunk portion 2*g* are formed in the mentioned order in front of the expanded diameter portion 2*e*.

On the other hand, the diameter in an axial cross section of the central electrode 3 is set smaller than that in an axial cross section of the resistor 15. The through hole 6 of the insulator 2 has a first substantially cylindrical portion 6*a* through which the central electrode 3 is inserted, and a second substantially cylindrical portion 6*b* formed to the rear (upper side in the drawing) of the first portion 6*a* with a diameter greater than that of the first portion 6*a*. The terminal metal member 13 and resistor 15 are held in the second portion 6*b*, and the central electrode 3 is inserted through the interior of the first portion 6*a*. The central electrode 3 is provided on a rear end portion thereof with an electrode fixing projecting section 3*c* projecting outward from the outer circumferential surface thereof. The first portion 6*a* and second portion 6*b* of the through hole 6 are connect at the intermediate trunk portion 2*g*, and a surface 6*c* where the first and second portions 6*a*, 6*b* are connected and where the electrode fixing projection 3*c* of the central electrode 3 is received is formed to be a tapering surface or a rounded surface.

An outer circumferential surface (i.e., the front end section of the intermediate trunk portion 2*g*) of a joint portion 2*h* between the intermediate trunk portion 2*g* and front end portion 2*i* is formed as a stepped surface, which is engaged with the projecting portion 1*c* as a main body metal member-side abutting portion, which is formed on an inner surface of the main body metal member 1, via a ring shaped sheet packing portion (not shown) to prevent the insulator from coming off in the axial direction. On the other hand, a ring shaped wire packing 62 engaged with the rear circumferential edge of the flange type expanded diameter portion 2*e* is provided between this and the inner surface of a rear side opened portion of the main metal member 1. On the rear of the wire packing 62, another ring shaped wire packing 60 is provided via a packed bed 61 of talc or the like. The insulator 2 is pushed forward into the main metal member 1, and the open edge of the main metal member 1 in this condition clamps inward toward the packing 60. As a result, a clamped portion 1*d* is formed, and the main metal member 1 is fixed to the insulator 2.

The main metal member 1 is formed cylindrically by using as a raw material an iron material suitable for cold working, for example, low carbon steel, and a carbon steel wire and the like for cold forging as defined in JISG3539 (1991), and constitutes a housing for the spark plug 100. The housing 100 is provided on an outer circumferential surface of the front end portion of the spark plug with an attaching screw portion 7 for fixing the spark plug 100 to an engine block (not shown). On the section of the outer circumferential surface of the main metal member 1 which is on the rear side of the attaching screw portion 7, a circumferentially extending flange type fixing seat portion 1*g* is formed so as to project outward. To the rear side of the fixing seat portion 1*g*, a tool engaging portion 1*e*, at which a tool, such as a spanner or a wrench and the like used to turn the attaching screw portion 7 of the spark plug 100 into a threaded hole in a cylinder head is engaged, is formed via a thin-walled joint portion 1*h* so that the tool engaging portion 1*e* projects outward along the circumference of the spark plug 100.

Figure 2:
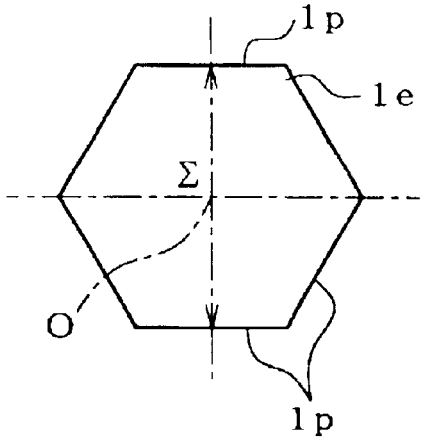
FIG. 2 is a drawing showing a definition of the length between opposite sides of a tool fixing portion.
Figure 2:
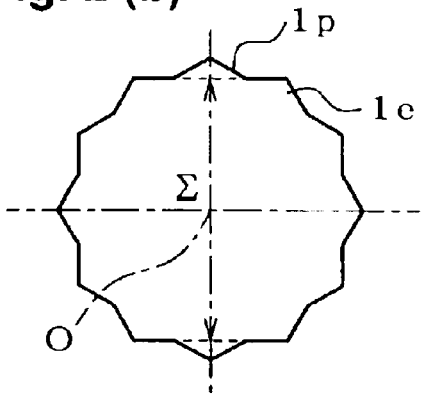

As shown in FIG. 2, the tool engaging portion 1*e* includes a plurality of pairs of tool engaging surfaces 1*p* parallel to the axis O and to each other and formed so as to extend in the circumferential direction. An example of the tool engaging portion 1*e* shown in FIG. 2(*a*) has three pairs of such tool engaging surfaces 1*p*, and is formed into a regular hexagonal cross sectional shape. An example shown in FIG. 2(*b*) is provided with twelve pairs of parallel tool engaging surfaces 1*p* (which is also called a BIHEX shape) formed by superposing two right hexagonal shapes on each other (which is also called a HEX shape) by staggering these two shapes from each other by 30° around the axis O. In all of these examples, the length between opposite sides Σ of the tool engaging portion 1*e* is expressed by the distance between opposite sides of the contour of a right regular hexagonal cross section. In the above-mentioned spark plug 100, the length between opposite sides Σ of the tool engaging portion 1*e* is not larger than 14 mm.

The inclined portion 2*j* has an outer circumferential surface which is inclined linearly so as to extend from a side of the expanded diameter portion 2*e* toward that of the intermediate trunk portion 2*g* as shown in FIG. 1(*b*) decreasing in diameter in orthogonal projections with respect to a plane of projection parallel to the axis O. In the position in which the inclined portion 2*j* and intermediate trunk portion 2*g* are connected together, i.e., the inner circumferential edge of one end surface of the expanded diameter portion, a valley-like portion is formed extending in the circumferential direction. This valley-like portion tends to receive, especially, stress concentration due to a notch effect. Especially, when the length between opposite sides Σ (FIG. 2) of the tool engaging portion 1*e* is not larger than 14 mm as mentioned above, the axial cross-sectional area of the insulator 2 necessarily decreases, so that the insulator 2 as a whole is shaped in an elongated manner and has a large total length with respect to the axial cross-sectional area thereof. Therefore, when a wrench is engaged with the tool engaging portion 1*e* with a large torsion for tightening the wrench applied thereto, or when a large impact force is exerted on the rear side main body portion 2*b*, etc., the bending moment working on the insulator becomes liable to increase proportionally to the large length thereof, and stress concentration on the valley type portion readily occurs.

Therefore, in this spark plug 100, a built-up portion 2*k* is formed in a position (valley type portion) of an intersection of extensions 2*j*', 2*g*' of the outer circumferential surface of the inclined portion 2*j* and that of the intermediate trunk portion 2*g* so that a valley-like space defined by the two extensions 2*j*', 2*g*' is filled. Owing to this arrangement, the occurrence of excessive stress concentration in the position in which the inclined portion 2*j* and intermediate trunk portion 2*g* are connected together can be avoided, and the bending resistance of the insulator 2 can be improved by a large margin even when bending moment is exerted greatly thereon.

Figure 5:
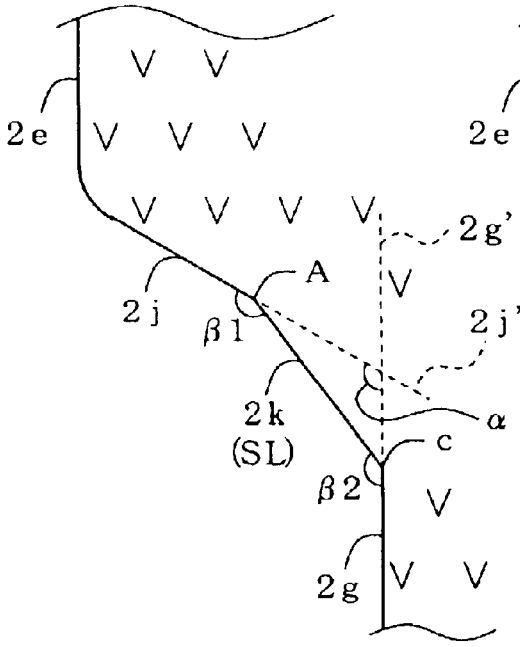
FIGS. 5(*a*) to 5(*d*) are sectional view showing various examples of the shape of a leveled-up portion formed on an insulator in the spark plug according to the present invention.
Figure 5:
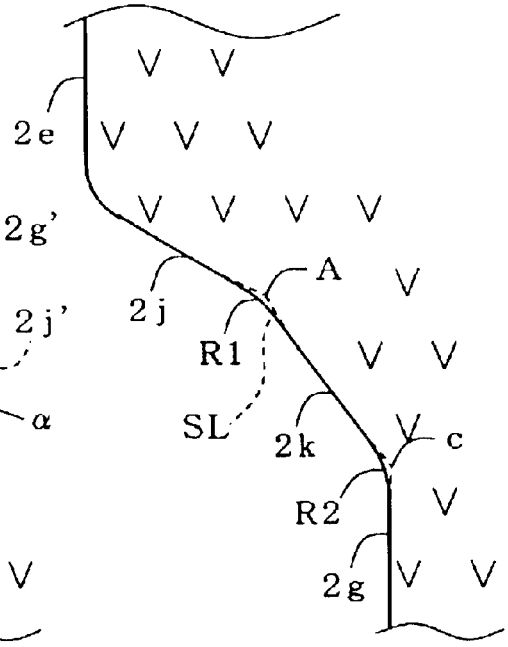
Figure 5:
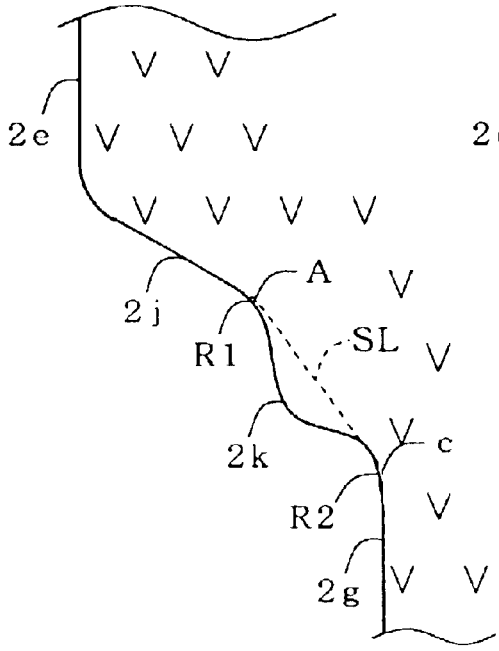
Figure 5:
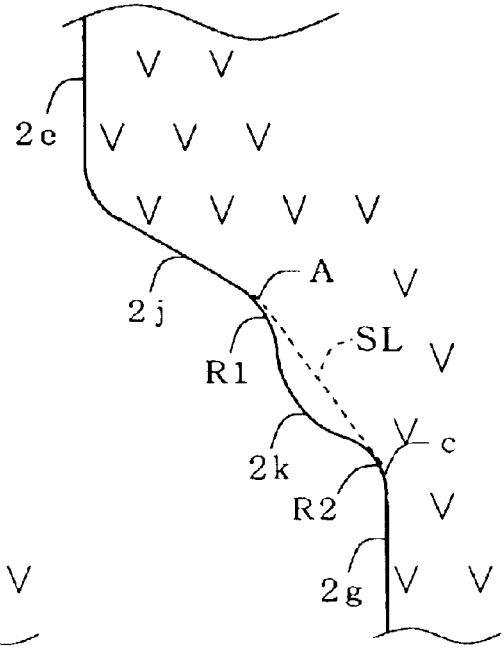

FIG. 5(*a*) shows the built-up portion 2*k* on a further enlarged scale. Angles β1, β2 at which a contour line of the built-up portion 2*k* and those of the inclined portion 2*j* and intermediate trunk portion 2*g* cross each other are evidently larger than an angle α (corresponding to a notch angle in a case where the built-up portion 2*k* is not formed) at which the extensions 2*j*', 2*g*' of the contour lines of the inclined portion 2*j* and intermediate portion 2*g* cross each other. As a result, stress on one recess of a smaller angle is scattered to two recesses of larger angles, so that the bending resistance of the insulator is improved. When in this embodiment recessed rounded portions R1, R2 are formed as shown in FIG. 5(*b*) in two points (first and second connecting points) A, c in which the outer circumferential surfaces of the built-up portion 2*k* and the inclined portion 2*j* and intermediate trunk portion 2*g* are connected to each other on the built-up portion 2*k*, stress concentration, which occurs in the first and second connecting points A, c, on the surfaces of the recesses is alleviated owing to provision of the rounded portions. This enables the bending resistance of the insulator to be further improved.

In order to further improve the bending strength of the insulator by forming the built-up portion 2*k*, it is desirable that the shape of the built-up portion 2*k* be set as follows. Namely, in orthogonal projections with respect to a plane of projection parallel to the axis O of the insulator, the outer circumference of the built-up portion 2*k* is the same as that of the surface defined by a reference line SL, i.e. a straight line which connects together the point A at which the outer circumferential surface of the built-up portion 2*k* and that of the inclined portion 2*j* are joined together and the point c at which the outer circumferential surface of the built-up portion 2*k* and that of the intermediate trunk portion 2*g* are joined together as shown in FIG. 5, or bulged radially outward from the circumferences of reference line SL. According to the present invention, the length between opposite sides Σ is not larger than 14 mm, so that the projection of the expanded diameter portion in the radial direction thereof is limited. However, when the built-up portion 2*k* is formed as mentioned above, the bending resisting strength improving effect can be secured even though the radius of the leveled-up portion is reduced to a certain extent. Therefore, these techniques can be applied satisfactorily to an expanded diameter portion 2*e* which has a small radius.

Figure 6:
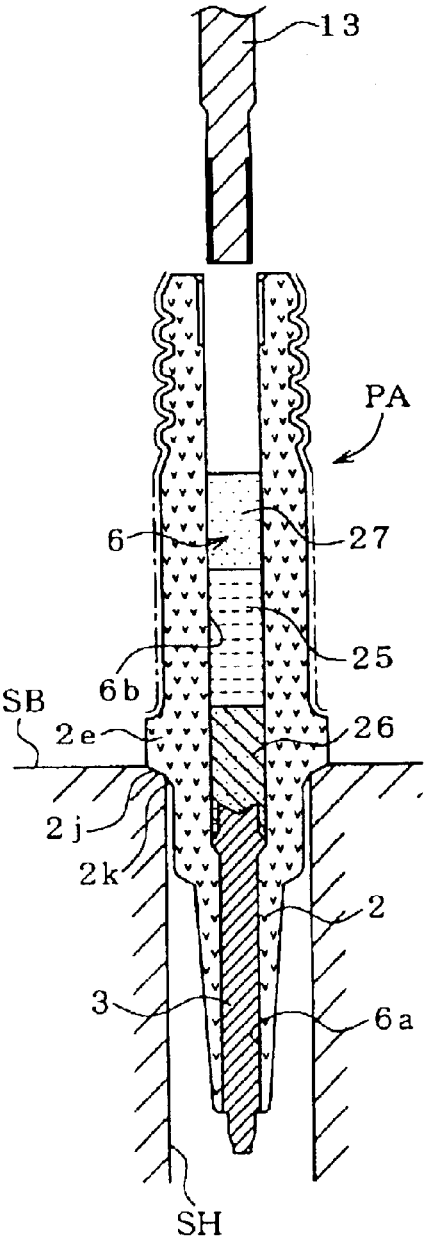
FIGS. 6(*a*) and 6(*b*) are drawings describing a glass sealing process.
Figure 6:
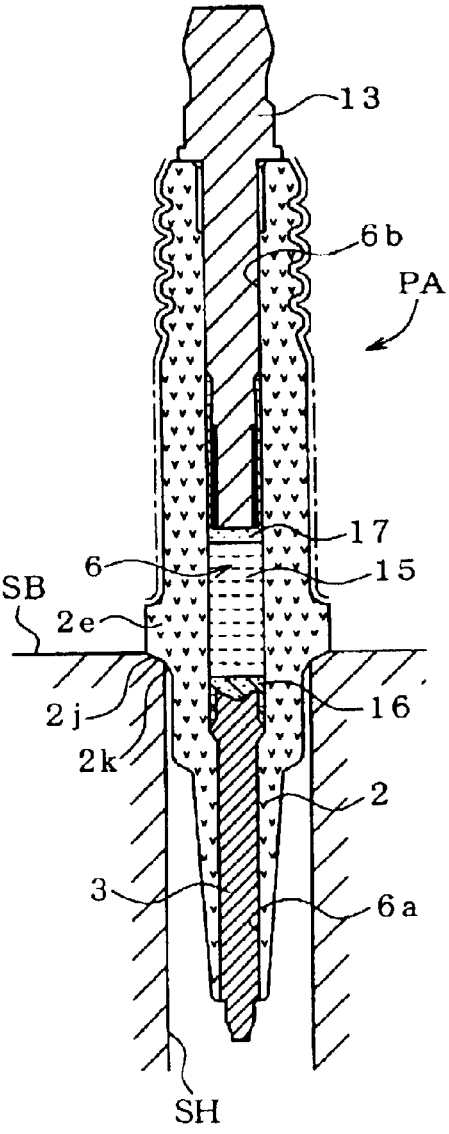

More particularly, the above-mentioned mode of the built-up portion 2*k* is specially effective in a case where the combining of the central electrode 3 and terminal metal member 13 with each other and the forming of the resistor 15 and conductive glass seal layers 16, 17 are done by such a glass sealing process as will be described below. First, the central electrode 3 is inserted into the first portion 6*a* of the through hole 6 of the insulator 2, and conductive glass powder and raw powder of a resistor composition are then packed in order therein, the resultant materials being then subjected to preparatory compression to form a product as shown in FIG. 6(*a*) in which a first conductive glass powder layer 26, a resistor composition powder layer 25 and a second conductive glass powder layer 27 are laminated from the side of the central electrode 3 (front side). An assembly PA having a terminal metal member 13 inserted from the above into the through hole 6 is then formed. The assembly in this condition is inserted in a heating furnace and heated to a predetermined temperature of 800 to 950° C. which is not lower than a softening point of glass. The terminal metal member 13 is thereafter press fitted axially into the interior of the through hole 6 from the side opposite that of the central electrode 3, and each of the layers 25 to 27 in a laminated state are pressed in the axial direction thereof. As a result, each layer is compress-sintered to be turned into the conductive glass seal layer 16, resistor 15 and conductive glass seal layer 17 as shown in FIG. 6(*b*).

In this glass sealing process, a considerable axial pressure is applied to the parts when each of the layers 25 to 27 in a laminated state is pressed axially with the terminal metal member 13 press fitted into the through hole 6. When the pressing operation is carried out, this pressure is received by inserting the insulator 2 into an insert hole SH of a support base SB from a front side thereof, and supporting the front side end surface of the expanded diameter portion 2*e* on the open outer circumferential edge of the insert hole SH. When during this time the built-up portion 2*k* is superposed on the circumferential edge of the insert hole SH, the built-up portion 2*k* is nibbled to cause the built-up portion 2*k* to be broken. Therefore, it is necessary to dispose the built-up portion 2*k* so that the built-up portion 2*k* as a whole is positioned in the insert hole SH.

Figure 3:
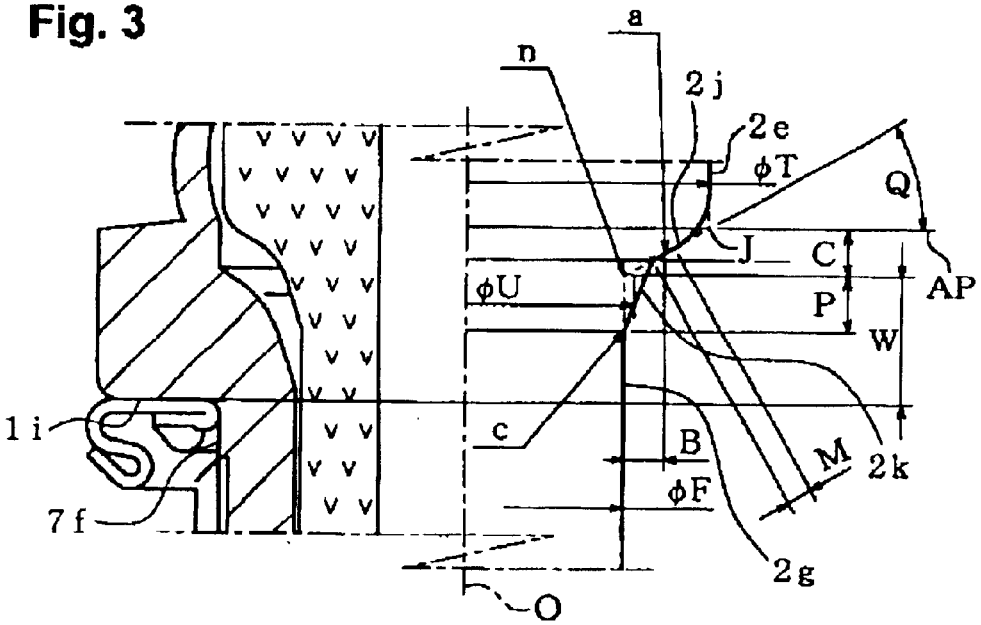
FIG. 3 is a drawing describing size symbols for each part of a principal portion of the spark plug of FIGS. 1(*a*) and (*b*).

In this case, the pressing force is wholly received by the inclined portion 2*j* positioned outside the built-up portion 2*k*, so that it is necessary to secure the width of the inclined portion 2*j* of not lower than a predetermined level irrespective of the radius of the projecting section of the expanded diameter portion 2*e*. Therefore, when the radius of the projecting section of the expanded diameter portion 2*e* decreases, the width of the built-up portion is necessarily reduced. However, since the built-up portion 2*k* of the above-mentioned shape can satisfactorily secure its resistance to bending even when the width of the leveled-up portion is small, the present invention can also be applied flexibly to a spark plug having a tool engaging portion 1*e* of small length between opposite sides As shown in FIG. 3, the width M of the outer circumferential surface of the inclined portion 2*j* is desirably set not smaller than 0.3 mm and not larger than 3 mm. When M is smaller than 0.3 mm, the sealing pressure cannot be stopped during the execution of a glass sealing step. When M exceeds 3 mm, the width of the built-up portion 2*k* becomes short, and the bending resisting strength improving effect becomes insufficient. It is desirable that an angle Q between a plane AP crossing the axis O at right angles thereto and the outer circumferential surface of the inclined portion 2*j* be not larger than 60°. When Q exceeds 60°, a seal-pressing force cannot be received sufficiently during the execution of the glass sealing step.

In the above-mentioned orthogonal projection, J represents a first intersection at which an extension of the cylindrical outer circumferential surface of the expanded diameter portion 2*e* and that of the outer circumferential surface of the inclined portion 2*j* cross each other; n represents a second intersection at which an extension of the outer circumferential surface of the built-up portion 2*k* and that of the outer circumferential surface of the intermediate trunk portion 2*g* cross each other; and c represents a second connecting point at which the outer circumferential surface of the built-up portion and that of the intermediate trunk portion 2*g* are connected together. In the direction of the axis O, W represents a distance measured from a front end surface 1*i* of the fixing seat portion 1*g* to the intersection n; P represents a distance measured from the second connecting point c to the second intersection n; and C represents a distance measured from the second intersection n to the first intersection J. It is desirable in this condition that dimensional conditions of:

$$W \geqq P \geqq 0.5C \tag{1}$$

be satisfied.

The reference letter P represents the length of the overlap of the built-up portion 2*k* over the intermediate trunk portion 2*g* in the direction of the axis O. The reference letter C corresponds to the length in the direction of the axis O of a front end surface of the expanded diameter portion 2*e* including the inclined portion 2*j*. When P becomes lower than 0.5C, the bending resistance improving effect becomes inconspicuous in some cases. On the other hand, P larger than W means that the built-up portion 2*k* exceeds the front end surface 1*i* of the fixing seat portion 1*g* and extends forward in the direction of the axis O. As a result, the thickness in the radial direction of the main metal member 1 lessens at a rear edge (so-called screw neck section) 7*f* of the attaching screw portion 7 thereof, and torsional rupture strength (which will hereinafter be referred to as screw neck strength) of the main metal member 1 cannot be secured sufficiently in some cases. For example, when excessive tightening torque is exerted on the main metal member during the fixing of the spark plug 100 to an engine head, inconveniences such as the breakage of the screw neck section 7*f* occur in some cases.

It is desirable that the intermediate trunk portion 2*g* of the insulator 2 has an outer diameter F of not smaller than 5 mm and not larger than 8 mm. When F is smaller than 5 mm, the bending resisting strength of the insulator 2 cannot be secured sufficiently due to the small thickness. When F exceeds 8 mm, the thickness of the attaching screw portion 7 becomes short, so that the screw neck strength decreases in some cases. When an attaching screw portion 7 having a nominal size of M10 or M12 is used, this tendency is shown markedly.

The insulator 2 is provided as mentioned above with a main body portion 2*b* having a diameter smaller than that of the expanded diameter portion 1*e*, and a cylindrical outer circumferential surface, and formed adjacently to the rear of the expanded diameter portion 2*e* with respect to the axis O. In the above-mentioned orthogonal projection shown in FIG. 4, K shall represent a position of a middle point of a sector connecting both ends of the cylindrical outer circumferential surface of the expanded diameter portion 2*e*; T a position of the rear end in the axial direction of the outer circumferential surface of the insulator 2; S the position of the front end in the direction of the axis O of the cylindrical outer circumferential surface of the intermediate trunk portion 2*g*; E a distance measured in the direction of the axis O from the position T of the rear end to the position K of the middle point; D a distance measured from the position S of the front end to the position K of the middle point; S1 an axial cross-sectional area (cylindrical outer circumferential surface portion, for example, position Y in the drawing) of a rear side section of the main body portion 2*b*; and S2 (cylindrical outer circumferential surface portion, for example, position X in the drawing) an axial cross-sectional area of the intermediate trunk portion 2*g* of the insulator. It is desirable that:

$$0.5 \leqq (S1/E)/(S2/D) \leqq 2 \quad (2)$$

be satisfied.

S1/E represents in terms of a ratio with respect to the axial cross-sectional area S1 the length of the section (which will hereinafter be referred to as a rear projecting section) of the expanded diameter portion 1*e* which exists on the rear side of the middle point thereof, and a smaller value means that this section projects in a more elongated manner). On the other hand, S2/D represents in terms of a ratio with respect to the axial cross-sectional area S2 the length of the section of the expanded diameter portion 1*e* which exists on the front side of the middle point thereof. When the ratio ((S1/E)/(S2/D)) of these two values becomes excessively large to exceed two, the axial cross-sectional area S2 of the intermediate trunk portion 2*g* becomes relatively short, and the rear projecting section becomes extremely long. As a result, when an impact, etc. is exerted on this section, a large bending moment becomes liable to be imparted to a boundary position between the intermediate trunk portion 2*g* and expanded diameter portion 2E. Consequently, it becomes difficult to sufficiently secure the bending resistance of the insulator 2. In the meantime, when the ratio becomes smaller than 0.5, the rear projecting section becomes too short conversely, so that inconveniences, such as flushover becomes liable to occur.

In the examples of FIGS. 5(*a*) and 5(*b*), the built-up portion 2*k* is formed in the orthogonal projection such that the outer circumferential surface thereof is substantially aligned with the circumferences defined by the reference line SL. The built-up portion 2*k* may also be formed so that the leveled-up portion bulges convexly in the radially outward direction from the reference line SL as shown in FIGS. 5(*b*) and 5(*d*). This enables the bending resisting strength of the insulator 2 to be further improved. Especially, as shown in FIG. 5(*d*), forming a projecting rounded portion on an intermediate section of the contour line of the built-up portion 2*k*, i.e., forming an apex section of a projecting contour line in a moderately rounded shape, enables the stress scattering effect to be further improved. In addition, forming the built-up portion 2*k* in such a shape is also effective in preventing the same portion (especially, in the form of a molded body not yet clamped) from being chipped.

EXAMPLES

In order to ascertain the effect of the present invention, the following tests were conducted.

Embodiment 1

Spark plug specimens in which the sizes shown in FIG. 3 and FIG. 4 were set as follows were produced (the parameters already described were shown by their symbols only).

Figure 4:
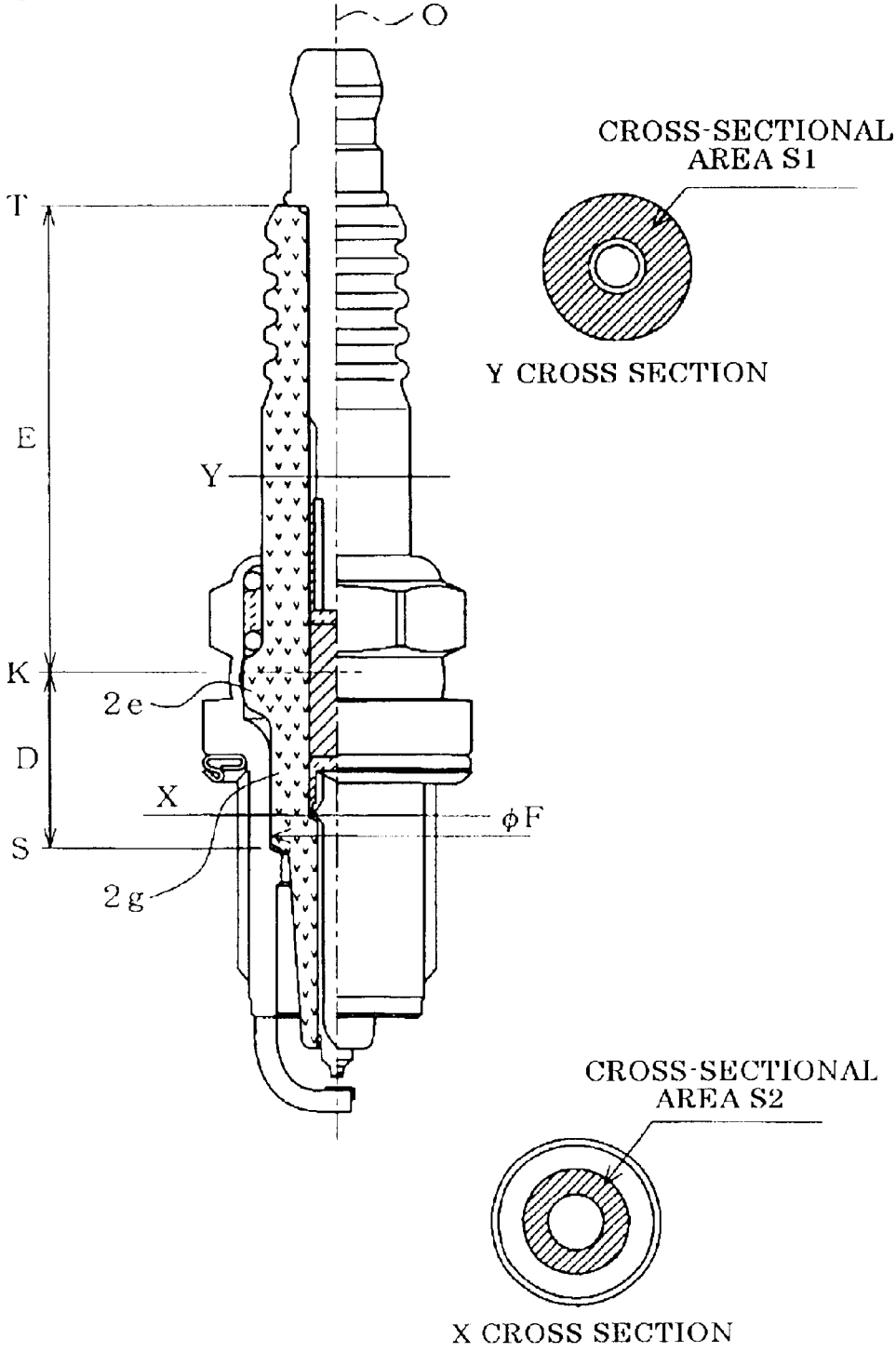
FIG. 4 is a drawing describing size symbols for each part shown in the general drawing of the spark plug of FIG. 1.

- Outer diameter F of the intermediate trunk portion 2*g*: 7.3 mm
- Outer diameter T of the expanded diameter portion 1*e*: 11 mm
- Angle Q: 30°
- Value of B≡(U−F)/2 wherein a represents the position of a boundary between a rounded portion formed between an inclined portion 2*j* and a built-up portion 2*k* and the inclined portion 2*j*; and U an outer diameter of an insulator 2 in the position a: 0.9 mm
- Cross-sectional area S1: 52 $mm^2$
- Cross-sectional area S2: 30 $mm^2$
- Width M: 0.64 mm
- Distance C in the axial direction between intersection n and intersection J: 1 mm
- Distance W: 3 mm (C/W=3)
- Distance E shown in FIG. 4: 33 mm
- Distance D shown in the same drawing: 21 mm
- Overlapping length P in the axial direction of the built-up portion 2*k* on the intermediate trunk portion 2*g*: 0.5 to 2.9 mm The following tests were conducted using spark plugs in which the length of the built-up portion 2*k* was regulated variously as mentioned above.

Figure 7:
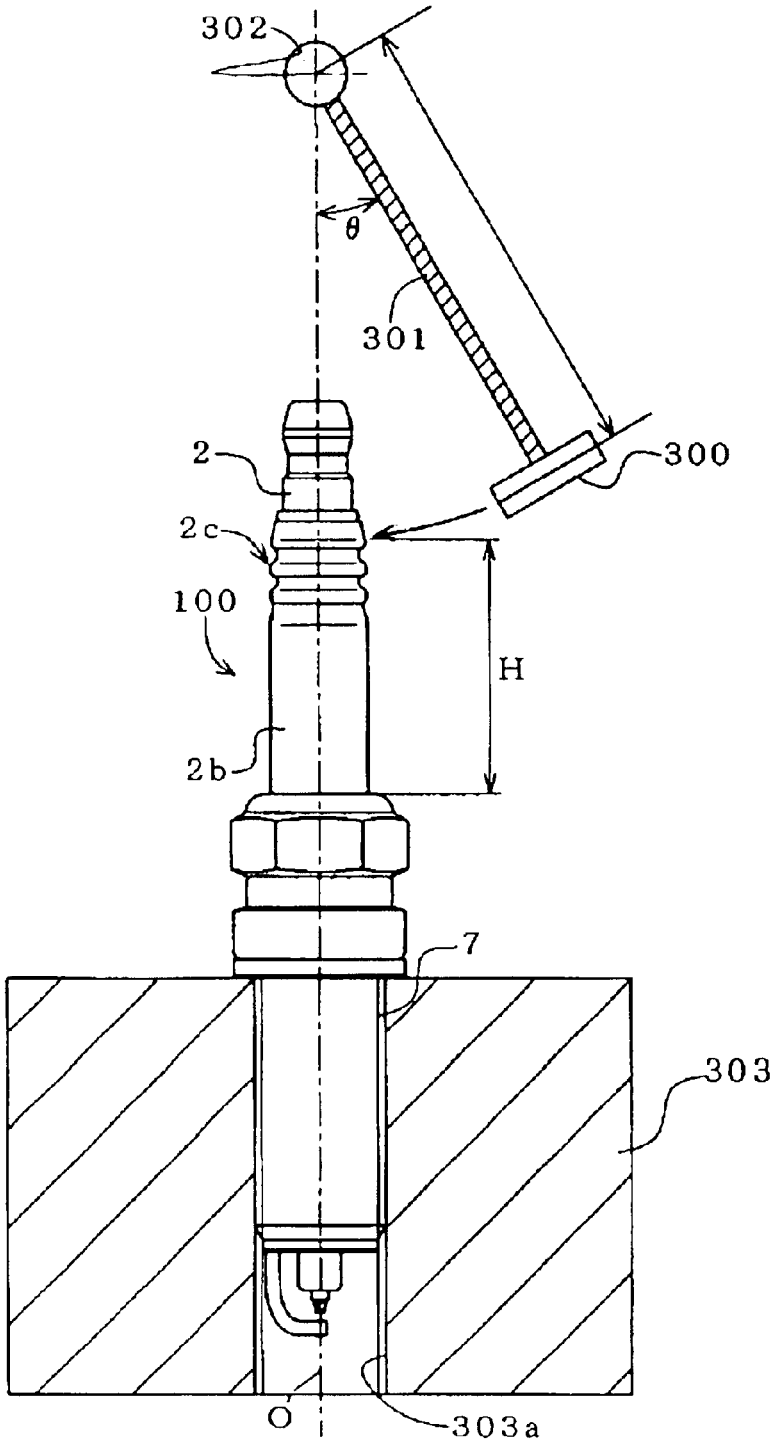
FIG. 7 is a drawing describing an impact resistance test.

<1> Impact resistance test: As shown in FIG. 7, an attaching screw portion 7 of each spark plug 100 is turned into a threaded hole 303*a* of a specimen fixing block 303, and fixed so that a main body portion 2*b* of an insulator 2 projects upward from the hole 303*a*. An arm 301 is fixed to an axial fulcrum 302 positioned on the portion of a central axis O of the insulator 2 which is still higher than the main body portion 2*b*, such that the arm can be swung. The length of the arm 301 is 330 mm, and the position of the axial fulcrum is determined so that a position of a front end 300 of the arm swung downward to a rear side section of the main body portion 2*b* is removed from a rear end surface of the insulator 2 by a vertical distance H of 10 mm. An operation of lifting a front end of the arm so that an angle at which the arm 301 is swung from the central axis O thereof attains a predetermined level, and swinging the arm downward by free falling toward the rear side section of the main body portion 2*b* is repeated at angle intervals of 2° which are increased gradually, to determine a value θ of an impact resisting angle at which the bending of the insulator 2 occurs. A larger angle θ means higher bending resistance (Charpy Strength).

<2> Screw neck strength test: A spark plug is fixed to a threaded bushing, and torsional torque is applied to the spark plug in the tightening direction with the fixing seat portion gripped, to determine a value of critical torque at which a screw neck portion is broken.

Figure 8:
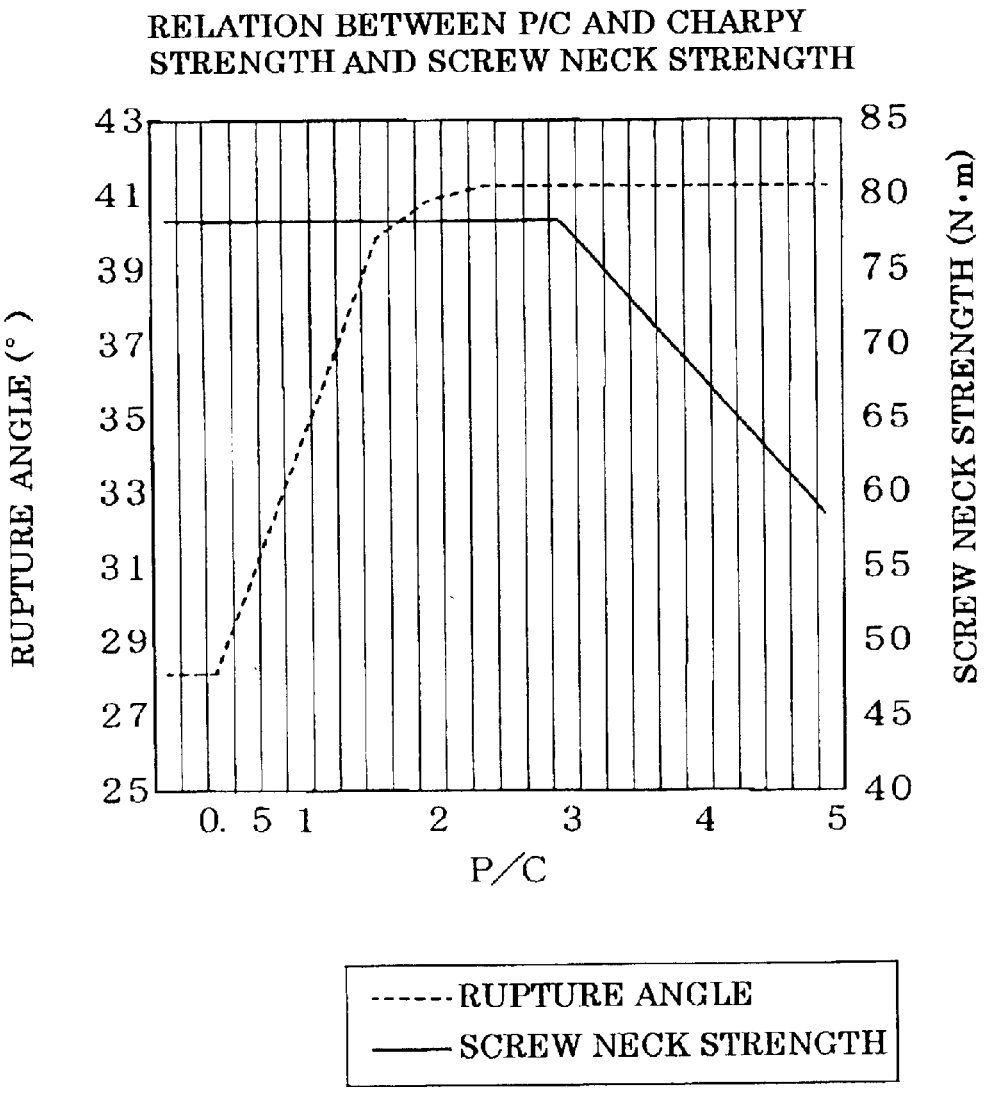
FIG. 8 is a graph showing the relationship between P/C, the value of impact resisting angle and screw neck strength.

The results of plotting these test results with respect to P/C are shown in FIG. 8. The expression (1) mentioned above can be transformed to:

$$W/C \geq P/C \geq 0.5 \quad (1)$$

It is understood from the results of a comparison between the impact resistance test results and the test results of FIG. 8 that, when P/C is smaller than 0.5, the bending resistance becomes excellent, and that, when P/C is not larger than 3 (i.e., not larger than W/C), the screw neck strength becomes excellent.

Embodiment 2

Spark plug specimens in which the sizes shown in FIG. 3 and FIG. 4 were set as follows were produced (the parameters already described are shown by their symbols only).

Outer diameter F of intermediate trunk portion 2*g*: 7.3 mm

Outer diameter T of expanded diameter portion 1*e*: 11 mm

Angle Q: 30°

Value B≡(U−F)/2 wherein a represents position of the boundary between the rounded portion formed between an inclined portion 2*j* and a built-up portion 2*k* and the inclined portion 2*j*; and U the outer diameter in the position a of an insulator 2: 0.9 mm Cross-sectional area S1: 51.7 $mm^2$ Cross-sectional area S2: 29.9 $mm^2$ ((S1/E)/(S2/D) is varied in the range of 0.5 to 2.0)

Width M: 0.64 mm

Distance C in the axial direction between an intersection n and an intersection J: 1.1 mm Distance W: 3 mm(C/W=3)

Distance E shown in FIG. 4: 33 mm

Distance D shown in the same drawing: 10 to 40 mm

Length P of overlap in the axial direction of a built-up portion 2*k* on intermediate trunk portion 2*g*: 0 mm (Shape 1: Comparative Example), 1.5 mm (Shape 2: Embodiments)

Figure 9:
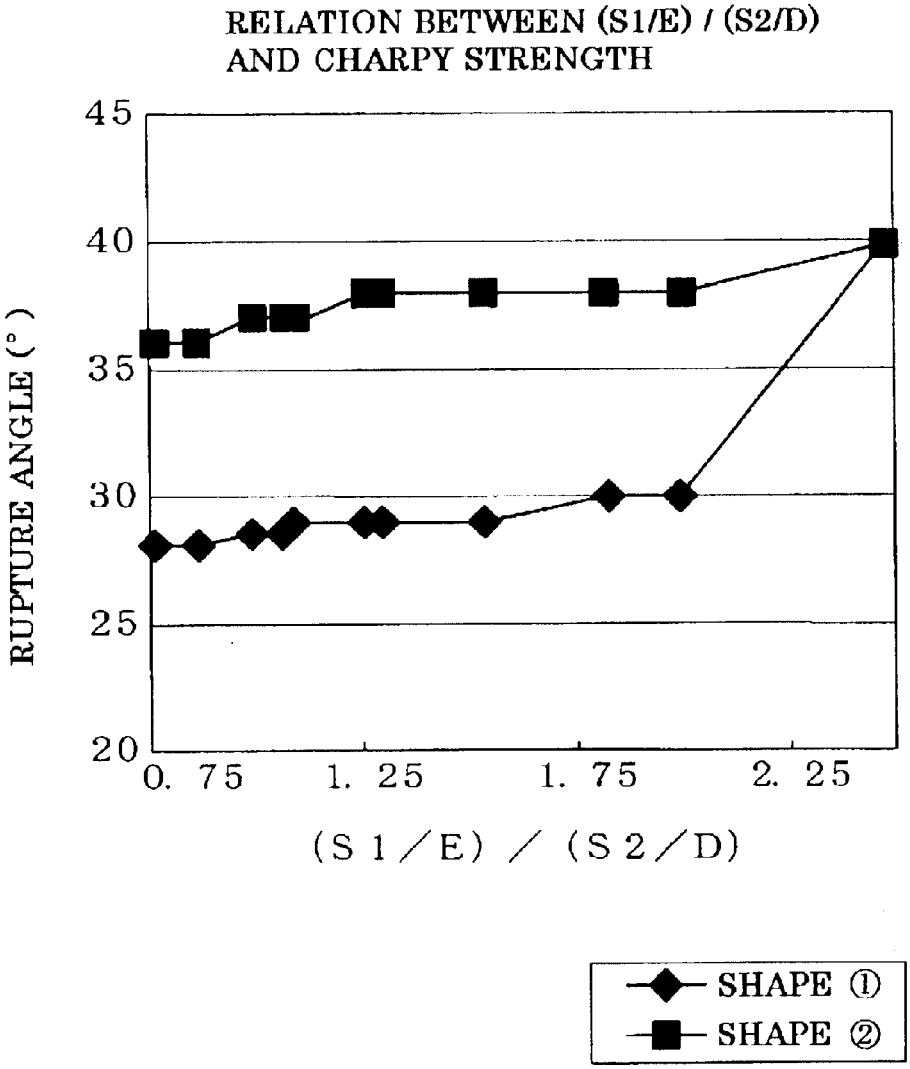
FIG. 9 is a graph showing the relationship between (S1/E)/(S2/D) and the value of impact resisting angle.

The same impact resistance tests as in Embodiment 1 were conducted using spark plugs in which (S1/E)/(S2/D) were regulated variously as mentioned above. The results are shown in FIG. 9. According to these results, the value θ of impact resistance angle decreases suddenly when (S1/E)/(S2/D) becomes two or less in Comparative Example (Shape 1) in which a leveled-up portion is not formed, while the value θ of impact resistance angle is large even when (S1/E)/(S2/D) is less than two in the Embodiment in which a leveled-up portion is formed. It is understood that a remarkable difference in bending resistance occurs between the specimens of the Embodiment and those of the Comparative Example.

It should further be apparent to those skilled in the art that various changes in form and detail of the invention as shown and described above may be made. It is intended that such changes be included within the spirit and scope of the claims appended hereto.

This application is based on Japanese Patent Application No. 2001-366640, filed Nov. 30, 2001, the disclosure of which is incorporated herein by reference in its entirety.

What is claimed is:

1. A spark plug provided with a shaft type central electrode (3), a shaft shaped insulator (2) covering the outer surface of the central electrode (3), a main metal member (1) which is formed cylindrically with both ends opened and which is disposed on an outer side of the insulator (2), and an earth electrode (4) joined at one end with the main metal member (1) and the other end of the earth electrode being opposed to the central electrode (3) so as to form a spark discharge gap g, said spark plug having a center axis O in an axial direction of the insulator (2), characterized in that:

the main metal member (1) is provided on its outer circumferential surface with an attaching screw portion (7) and a tool engaging portion (l*e*) to enable turning the attaching screw portion (7) into a threaded hole in an internal combustion engine, the length from side to side Σ of the tool engaging portion l*e* being not larger than 14 mm, the side in the axial direction of the insulator 2 on which the spark discharge gap g is formed is defined as the front side and the opposite side thereof is defined as the rear side, the insulator (2) is provided with an expanded diameter portion (2*e*) positioned in the main metal member (1) and projecting radially outward from an outer circumferential surface of the insulator (2), and an intermediate trunk portion (2*g*) having a cylindrical outer circumferential surface, formed adjacently in the axial direction to a front side of the expanded diameter portion (2*e*) and engaged at its front end with a main metal member-side engaging section (1*c*) formed on an inner circumferential surface of the main metal member (4), an outer circumferential surface of an inclined portion (2*j*) forms a linear incline in a position connecting the expanded diameter portion (2*e*) and intermediate trunk portion (2*g*), such that the diameter of the inclined portion (2*j*) decreases from the expanded diameter portion (2*e*) toward the intermediate trunk portion (2*g*) in orthogonal projections with respect to a plane of projection parallel to said axis, a built-up portion (2*k*) being formed where an extension of the outer circumferential surface of the inclined portion (2*j*) and that of the intermediate trunk portion (2*g*) cross each other, such that a valley-like space defined by these extensions is filled with the built-up portion (2*k*).

2. The spark plug as claimed in claim 1, wherein an outer circumferential surface of the built-up portion (2*k*) has a concave rounded section formed where the built-up portion is connected to the outer circumferential surface of the inclined portion (2*j*) and to the outer circumferential surface of the intermediate trunk portion (2*g*).

3. The spark plug as claimed in claim 1, wherein the outer circumferential surface of the built-up portion (2*k*) is in a position on or bulged radially outward from a reference line formed in said orthogonal projection by a straight line connecting together a point A in which the outer circumferential surface of the built-up portion (2*k*) and that of the inclined portion (2*j*) are connected together and a point c in which the outer circumferential surface of the built-up portion (2*k*) and that of the intermediate trunk portion (2*g*) are connected together.

4. The spark plug as claimed in claim 1, wherein a projecting rounded portion is formed on an intermediate section of a contour line of the built-up portion (2*k*).

5. The spark plug as claimed in claim 1, wherein the width of the outer circumferential surface of the inclined portion (2*j*) is not smaller than 0.3 mm and not larger than 3 mm, an angle between a plane Q of said orthogonal projection crossing the axis at a right angle and the outer circumferential surface of the inclined portion 2*j* being not larger than 60°.

6. The spark plug as claimed in claim 1, wherein a flange shaped fixing seat portion (1*g*) is formed on the part of the outer circumferential surface of the main metal member (1) between the tool engaging portion (1*e*) and attaching screw portion (7), and the relation $W \geqq P \geqq 0.5C$ is satisfied, wherein, in the orthogonal projection, a first intersection J is the intersection of where the extension of the cylindrical outer circumferential surface of the expanded diameter portion (2*a*) and that of the inclined portion (2*j*) cross each other; a second intersection n is the intersection of the extension of the outer circumferential surface of the inclined portion (2*j*) and that of the outer circumferential surface of the intermediate trunk portion (2*g*); c is the point at which the outer circumferential surface of the built-up portion (2*k*) and that of the intermediate trunk portion (2*g*) are connected together; W is the distance in the direction of the axis from the front end (1*i*) of the fixing seat portion (2*g*) to the second intersection n; P is the distance from the first connecting point c to the second intersection n; and C is the distance from the second intersection to the first intersection J.

7. The spark plug as claimed in claim 1, wherein an outer diameter of the intermediate trunk portion (2*g*) is not smaller than 5 mm and not larger than 8 mm.

8. The spark plug as claimed in claim 1, wherein a main body portion (2*b*) having a cylindrical outer circumferential surface, the diameter of which is smaller than that of the expanded diameter portion (2*e*), is formed on the insulator so that the main body portion (2*b*) adjoins the axial rear section of the expanded diameter portion (2*e*), and the relation $0.5 \leqq (S1/E)/(S2/D) \leqq 2$ is satisfied, wherein, in orthogonal projection, K represents the position of the midpoint of an axial line connecting both ends of the cylindrical outer circumferential surface of the expanded diameter portion (2*e*); T represents the position of the rear end in the axial direction of the outer circumferential surface of the insulator (2); S represents the position of the front end in the axial direction of the cylindrical outer circumferential surface of the intermediate trunk portion (2*g*); E represents a distance measured in the axial direction from the position T of the rear end to the position K of the middle point; S1 represents the axial cross sectional area of the main body portion (2*b*); and S2 represents the axial cross sectional area of the intermediate trunk portion (2*g*).

* * * * *